US006204817B1

(12) United States Patent
Edvardsson

(10) Patent No.: US 6,204,817 B1
(45) Date of Patent: Mar. 20, 2001

(54) RADIO COMMUNICATION DEVICE AND AN ANTENNA SYSTEM

(75) Inventor: Olov Edvardsson, Täby (SE)

(73) Assignee: Allgon AB, Akersberga (SE)

( * ) Notice: Subject to any disclaimer, the term of this patent is extended or adjusted under 35 U.S.C. 154(b) by 0 days.

(21) Appl. No.: 09/405,102

(22) Filed: Sep. 27, 1999

(30) Foreign Application Priority Data

Sep. 28, 1998 (SE) ..... 9803286

(51) Int. Cl.[7] ..... H01Q 1/24
(52) U.S. Cl. ..... 343/702; 343/742; 343/867
(58) Field of Search ..... 343/700 MS, 702, 343/726, 727, 728, 729, 741, 866, 870, 742, 744, 748, 893, 867; H01Q 1/24

(56) References Cited

U.S. PATENT DOCUMENTS

| | | | | |
|---|---|---|---|---|
| 4,584,707 | | 4/1986 | Goldberg et al. | 455/41 |
| 4,747,158 | | 5/1988 | Goldberg et al. | 455/11 |
| 5,231,407 | | 7/1993 | McGirr et al. | 343/700 |
| 5,317,326 | * | 5/1994 | Tay et al. | 343/718 |
| 5,649,306 | | 7/1997 | Vannatta et al. | 455/575 |
| 5,751,252 | * | 5/1998 | Phillips | 343/726 |
| 5,767,809 | * | 6/1998 | Chuang et al. | 343/700 MS |
| 5,990,839 | * | 11/1999 | Schefte et al. | 343/702 |

FOREIGN PATENT DOCUMENTS

| | | |
|---|---|---|
| 2161862 | 5/1997 | (CA) . |
| 0214806 | 3/1987 | (EP) . |
| 0648023 | 4/1995 | (EP) . |
| 0649227 | 4/1995 | (EP) . |
| 0752735 | 1/1997 | (EP) . |
| 0767511 | 4/1997 | (EP) . |
| WO91/01048 | 1/1991 | (WO) . |
| WO95/04386 | 2/1995 | (WO) . |
| WO 9700542 | 1/1997 | (WO) . |
| WO97/26713 | 7/1997 | (WO) . |
| WO98/18175 | 4/1998 | (WO) . |

* cited by examiner

*Primary Examiner*—Don Wong
*Assistant Examiner*—Shih-Chao Chen
(74) *Attorney, Agent, or Firm*—Jacobson, Price, Holman & Stern, PLLC

(57) ABSTRACT

A portable radio communication device, comprising: a housing (78); antenna means for transmitting and receiving RF signals; transmitting and receiving circuits arranged in the housing; at least a conductive portion; antenna feeding means; and, a user interface. The antenna means includes a transmitting antenna (60, 61), and a receiving antenna (60, 61, 65, 78). The transmitting antenna, and the receiving antenna have orthogonal radiating characteristics in relation to each other. The transmitting and the receiving antennas can be of an electric dipole type or a magnetic dipole type. An antenna system including a transmitting and a receiving antenna is also disclosed.

39 Claims, 15 Drawing Sheets

RADIO COMMUNICATION DEVICE AND AN ANTENNA SYSTEM

FIELD OF THE INVENTION

The invention relates to a portable radio communication device, comprising: a housing; antenna means for transmitting and receiving RF signals; transmitting and receiving circuits arranged in the housing; at least a conductive portion; a power source; and, a user interface.

Further it relates to an antenna system for transmitting and receiving RF signals from and to a portable radio communication device, comprising: a first antenna, being a transmitting antenna, and being connectable to transmitting circuits of the radio communication device; and, a second antenna, being a receiving antenna, and being connectable to receiving circuits of the radio communication device. Specifically, it relates to an antenna device for a mobile radio communication device, e.g. a hand-portable telephone.

RELATED ART AND BACKGROUND OF THE INVENTION

Antenna systems of the type mentioned above are previously known from U.S. Pat. No. 5,231,407 and WO-A1-91/01048. One advantage of the separation between transmitter and receiver is that the requirements for duplexing filters will decrease. However, a problem is the coupling between the transmitting and the receiving antennas. To decrease said coupling the antennas used in U.S. Pat. No. 5,231,407 are tunable narrow band antennas, while the antennas described in WO 91/01048 are arranged at different ends of the telephone.

At first sight, the use of more than one antenna can be seen as waste of space etc., but nevertheless, a number of inventors have pointed out numerous advantages. The present invention can be said to be a new and inventive way to utilise the concept of two or more antennas or antenna functions for operation in respect of a single system transmitting/receiving band, to save space and decrease losses in human tissue. Some further examples of the use of more than one antenna that are known, used for achieving diversity or directional properties, for minimising the influence of a users hand, and for satellite telephones.

To achieve diversity, more than one receiving antenna is used together with one transmitting antenna (usually the same as one of the receiving antennas). 5–10 dB fading reduction is reported as a result of the use of diversity reception. EP-B1-0 214 806 and EP-A1-0 648 023 disclose two examples thereof. A further example is shown in WO-A1-95/04386. Diversity is standard in the Japanese PDC system and typically one whip antenna combined with one PIFA (Planar Inverted F Antenna) are used.

Directional properties have been suggested in order to improve antenna gain in the direction of the base station (i.e. in a variable way) and to suppress interfering sources. EP-A1-0 649 227 is one example.

EP-A1-0 752 735 discloses the use of multiple antennas in order to minimise the influence of the users hand, simply by using one of the antenna elements which are not covered by the hand (as detected by the VSWR).

Satellite telephones generally have strong requirements on the antennas, such as big difference between transmitting and reception frequencies or extreme requirements on low losses (i.e. filters should be avoided). WO-A1-97/26713 and WO-A1-98/18175 are two examples hereof, where separate transmitting and receiving antennas with the same circular polarisation are used.

Modern mobile phones are small and thus the interaction between antenna, phone body and user will become more important than earlier. There is also normally a requirement for two or more frequency bands and a recent trend is to integrate the antenna function into the telephone body making it invisible from the outside, which is customary named built-in antenna. According to the present invention, a number of benefits can be achieved by using separate antennas for transmitting and receiving if they are implemented according to special principles of the present invention, which will be described below. The requirements for transmitting and receiving antennas are quite different and with the diminishing size it becomes more and more important to optimise each of them separately. It is well known that antenna performance will go down when the antenna is made smaller.

Since the mobile telephones today are very small and the antennas, during telephone calls, will be located close to the head of a user, much attention is paid to the effects on the human body when exposed to electric fields. An issue especially discussed is the SAR (Specific Absorption Rate) values, which preferably should be low. In the documents mentioned above, no efforts are shown how to decrease the SAR values.

SAR (Specific Absorption Rate) is used to quantify electromagnetic fields in respect of influence to the human body, and is also applicable in the near field. SAR is defined as the power loss per a certain unit of body tissue, and for instance FCC (Federal Communications Commission) in the US requires less than 1.6 mW per gram. The phone systems require a certain power level (such as 2 W peak and 0.25 W average for GSM in highest power level). It should however be noted that, the field near the antenna can be different for different types of antennas, even if the field far from the antenna should be the same. SAR is measured inside a dummy head, or can be calculated. Due to SAR's nature of power density, a smaller antenna structure carrying the same power as a bigger structure is more likely to be close to the limit value. This is the case for most phones using small antennas. The general development of the phones thus calls for SAR optimised solutions. Bigger antenna structures will generally cause lower SAR values, but modern telephone design requirement do not support increasing size. Antenna efficiency is another important characteristic and efficiency and SAR are somewhat correlated as high SAR obviously means extra losses. The term SAR will be used herein when reference to existing limits (stated by FCC, CENELEC etc.) or corresponding measuring methods is relevant but otherwise the more general expression "losses in human tissue" will be used.

To define some terms reference is made to FIG. 1*a*, which shows a typical telephone with a helical antenna, which is one of the most common types of antennas today. The user 1 holds the telephone body 2, provided with an antenna 3, to the ear 4. The radiated power Prad has to comply with the requirement of the telephone system in question. Prad is smaller than the power Pin fed by the transmitter, and the quotient between them gives the efficiency. A part of the loss in the human tissue (head, hand, etc.), causes a (very small) heating 5 of the human tissue close to the antenna, and many times more heating occurs at locations as 6 along the phone. For the subsequent discussion it should be noted that the telephone configuration in FIG. 1*a* can be understood as a very asymmetric electric dipole as shown in FIG. 1*b*. The asymmetric dipole 1*b* differs from the common symmetric dipole in FIG. 1*c* only by its feeding impedance. The currents along the dipoles 1*b* and 1*c* are the same, which is the reason for the occurrence of the current and loss maximum at 5 in FIG. 1*a*.

For a transmitting antenna, both SAR and efficiency are important. For losses in human tissue it can be shown that various small antennas radiating the same power and located on the same distance from the ear can give values differing more than 100 times. Should much lower SAR values be required than those that can be achieved by the typical antenna of today, it will be necessary to use some of the more efficient antenna principles with regard to the losses in human tissue. Naturally magnetic type antennas (loops etc.) will give less SAR in their near field as compared to antennas of the electric dipole type. This can be exemplified by studying the fields from a electric dipole and a magnetic dipole, radiating the same power. When r decreases, the electric fields are increasing as $1/r^3$ and $1/r^2$, respectively, and thus the magnetic dipole ($1/r^2$) will have much lower E-field (corresponding to SAR) at very small distances, in spite of the same field at long distances.

The fields of the electric dipole are illustrated very schematically in FIG. 2*a* where a simple linear antenna 10, typically half a wavelength or smaller, in total length, is fed over its symmetric gap 11 by a feeding line 12. The dipole is directed along the z-axis in a thought co-ordinate system where the electric 13 and magnetic 14 field can be described by the following equations expressed in standard spherical co-ordinates r, θ and φ:

$$E_r = \frac{Z_0 Il\cos\theta}{2\pi}\left(\frac{1}{r^2} + \frac{1}{jkr^3}\right)$$

$$E_\theta = \frac{Z_0 Il\sin\theta}{4\pi}\left(\frac{jk}{r} + \frac{1}{r^2} + \frac{1}{jkr^3}\right)$$

$$H_\varphi = \frac{Il\sin\theta}{4\pi}\left(\frac{jk}{r} + \frac{1}{r^2}\right)$$

Where:

k=wave number (=$2\pi/\lambda$), $Z_0$=377 Ω,

I=current, l=effective length.

FIG. 3*a* shows the corresponding fields around a magnetic dipole exemplified by a small ring 16 fed with current from a line 17. Its corresponding electric 18 and magnetic 19 fields are similar to those of the electric dipole. With suitable scaling they are in fact identical if electric E and magnetic H fields are exchanged and scaled. The mathematical expressions are:

$$H_r = \frac{AI\cos\theta}{2\pi}\left(\frac{jk}{r^2} + \frac{1}{r^3}\right)$$

$$H_\theta = \frac{AI\sin\theta}{4\pi}\left(-\frac{k^2}{r} + \frac{jk}{r^2} + \frac{1}{r^3}\right)$$

$$E_\varphi = \frac{Z_0 AI\sin\theta}{4\pi}\left(\frac{k^2}{r} - \frac{jk}{r^2}\right)$$

Where, further: A=area of the loop.

One important property obvious from those equations is that the far fields (radiation fields) for increased distance r decays as 1/r while the radiated power is preserved. Close to the dipole the variation with distance is $1/r^2$ or $1/r^3$, and this is illustrated by FIGS. 2*b* (electric dipole) and 3*b* (magnetic dipole). Close to the dipole the radial field is strongest, and the radial field is electric for the electric dipole and magnetic for the magnetic dipole. The radial fields disappears far away from the dipole. Losses in human tissue are depending on the electric field a human body is exposed to, and since the losses occur very close to the radiating structure, an electric dipole will have very different SAR properties compared to those of a magnetic dipole.

The field at a distance $d_n$ very near a dipole ($d_n<\lambda/10$) is quite different from the radiation field at a distance $d_f$ far away from the dipole ($d_f>\lambda/2$). SAR is depending on the near field only, while the radiation is depending on the far field only. It is an interesting fact that different antennas having the same radiated power may have very different near field. One of the really efficient way to reduce losses in human tissue is thus to choose the proper antenna element rather than reducing both far field and near field, which is done by various non-approved attenuating products on the market said to "screen" the radiation. Most modern cellular systems will try to increase output power to maintain the radio connection causing shorter battery lifetime and less reception sensitivity but generally not a relatively decreased nearfield.

It can also be expected that antenna structures isolated from the phone body (by distance or symmetry) would have less losses as many phones show maximum loss per unit of volume somewhere along the phone body, due to the currents along the same.

One SAR measurement of a magnetic dipole structure is given in: "Miniature dielectric loaded personal antenna with low user exposure", Leisten et. al., Electronics letters, Aug. 20, 1998.

It is well known that the size of an antenna is critical for its performance, (see Johnsson, Antenna Engineering Handbook, McGrawHill 1993, chapter 6) which can be expressed as a limitation of the product of the relative bandwidth (Δf/f) and the efficiency (η), which always is smaller than a constant multiplied by the efficient volume (V) of the antenna (as expressed in cubic wavelengths):

$$(\Delta f/f)\eta < \text{constant } (V/\lambda^3)$$

The constant has been suggested to be close to 13, but in many cases it is far from obvious to determine the "effective volume of an antenna", since it may include a portion or a quite large portion of the exterior structure (typically the whole) of the telephone body. Because of this, the equation generally can not be used for accurate calculations, but rather to predict an approximate size. The size predicted by this equation apply for an antenna in the 900 MHz band, comparable to the whole phone body, and the typical antenna in that band does indeed engage the whole telephone to support the currents creating the radiation. Due to its size the typical phone antenna of today for GSM, AMPS etc. is thus rather a coupling structure to the phone body itself which at 900 MHz is a crude approximation of a λ/2-dipole antenna. For clarification, when the word antenna is used in the following, it relates to the whole part that participates in the radiation. Antenna element is that part (e.g. a helical element, PIFA etc.) which is fed via a feed portion. The typical mobile phone antenna used today consists of the conducive portion of the phone (circuit board, screening structures and perhaps conductive housing) fed by the antenna element. The same antenna element can be included in plural antenna functions, when fed in different feeding modes. The current on the phone body is generally a significant contribution not only to the radiation but also to the SAR. As a consequence of this volume condition, an antenna comprising a small antenna element, which is isolated from the phone body will have a small volume compared to the phone body, and is thus also probably a rather poor antenna in terms of efficiency and bandwidth, if it is necessary to cover the full GSM-band. The term "small supporting structure" will be used subsequently herein about rather small structures, typically having a greatest measure of one wavelength or smaller, which are supporting an antenna element of the same or smaller size. One important property when designing mobile phone antennas in contrast to antennas mounted on big structures (towers, vehicles etc) is that the mobile phone must be able to operate by itself and antenna pattern, antenna impedance and other characteristics will be heavily influenced by the limited size of the structure. This will be different for different antennas but antennas intended to be mounted on a ground plane (such as a monopole or slot on a ground plane) will have a very different radiation pattern if the ground plane is just one or two wavelengths large as compared to the case when the same antenna is mounted on an "infinite ground plane" which can be understood as several wavelengths big. For the common helical antenna (normal helix) on a mobile phone it can be verified that while its radiating impedance on a large ground plane may be 2–3 ohms the impedance when installed on a mobile phone typically have increased to 15–20 ohms. This will change the conditions significantly for the function and design of the antenna, for instance in terms of bandwidth. Because of this drastic differences it is most cases necessary to distinguish between the function of antennas mounted on "a large structure" and antennas mounted on "a small structure" but obviously this distinction is only necessary when the antenna itself is a "small structure". The term "small supporting structure" will be used to characterise these cases. The chapter 6 (by Wheeler) in "Antenna Engineering Handbook" referenced above describes "small antennas" in the meaning that they can be enclosed in a sphere having one wavelength or less as circumference ("radiansphere"). On a phone this generally applies to the antenna element itself but in most cases not to the whole phone. Wheelers' term "small antennas" or "radiansphere" should thus not be confused with the term "small supporting structure" used herein.

For a receiving antenna the interaction with the user does not create any SAR problem. On the contrary, the efficient volume of the antenna can be increased by the presence of a user. Interaction with the user may thus even be favourable. For sensitivity purpose, a second receiving antenna can be included to implement diversity function. This can be done by adding a separate antenna, or in some cases by including a second receiving antenna in the transmitting antenna.

There will also be a change of the coupling when the phone is gripped by the hand of a user. Different specific designs of individual antenna elements can have very different degradations. It should be recalled that most present phone antennas actually are coupling elements to the body of the phone which is radiating by carrying currents along its length. This is generally independent of the appearance or type of the antennas.

Nearly all modern mobile phones can be described as electric dipoles directed along the phone which for simplicity is named "vertical" below. From the observations above this implies relatively high SAR and decreased radiation efficiency. The antenna is here the antenna element plus at least a part of the phone body and the far field radiating function have essentially the same radiation characteristics regardless of the antenna element being a helix in the top of the phone, a PIFA on its back or side, a slot antenna on its back etc. In this group are also included short extendible whip antenna elements which using the terminology herein constitutes one antenna but which can be mechanically modified to improve some properties. In a pictorial way for the receiving mode, a part of the electric field around the phone is "attracted" by the antenna element (helix, PIFA etc.), so that a portion of the displacement current of the electric field enters the antenna element.

Telephones having external antennas which are or can be directed more or less perpendicular to the head are known. FIG. 4 shows one example according to EP-A1-0806809 having an antenna 52, which can be bent. By the bending and the length of the whip antenna, the radiation will be, to a rather large extent, related to an electric dipole perpendicular to the skin. This may be expected to increase the efficiency.

Magnetic dipoles in the shape of a ferrite core have been used in paging systems in the HF to lower VHF frequency range. They are typically attached near the waist or placed in a pocket and thus parallel to the local surface of the body.

FIG. 5 shows an example of this, with the pager 53 attached adjacent to the waist 54 of a user, and fitted with a ferrite core 55 acting as a magnetic dipole. Ferrites have so far been quite poor at the frequencies used as mobile phone frequencies, otherwise this method would improve the magnetic dipole. Their efficiency is greatly increased by the presence of the user. These antennas are only used as receiving antennas, and not as transmitting antennas.

Depending on field and polarisation some antennas will have improved function close to the user, while other will have degraded performance. Most modern antennas belong to the second group. The above mentioned pager antenna and the antenna disclosed in EP-A1-0806809 belong to the first group. With the simplifying assumption that a telephone is shaped like a box, the division of phone antennas into six types (two kinds of dipoles times three perpendicular geometrical orientations) is useful to characterise their radiation properties, and their type of interaction with the user.

The reason for the very common use of an antenna combination, such as a vertical electric dipole transmitting antenna and a vertical electric dipole receiving antenna, which has some less favourable properties as mentioned above, is probably the difficulty to obtain efficiency and bandwidth within the small space available within the phone. The easiest way to obtain radiation efficiency and bandwidth in free space measurements is to use the length of the phone (typically around $\lambda/2$ at GSM/AMPS). The "expense" is a relatively high SAR and a considerable reduction of the efficiency when the phone is moved from "free space" position to "talk position". For a typical mobile phone the efficiency, in practical use, is about 10% as compared to an ideal case ($\lambda/2$-dipole in free space). This figure can be readily improved by using an antenna element giving less degrading interference with the user. One conclusion from this is that the telephone preferably should be optimised for talk position rather than for free space. One important part of the invention is to avoid the destructive interference with a user. Furthermore the SAR is normally close to the upper limit allowed by for instance FCC in USA. It should be observed that the statements herein about the overall electric dipole function applies to small antennas only (fixed helices or "built-in" antennas). For instance an extendible antenna of essentially half-wavelength typically has low losses in human tissue and corresponding high efficiency due to its isolated function relative to the body of the phone. Phones of regular size for operation at higher frequencies (1700–1900 MHz) are "bigger" as expressed in wavelengths, generally improving the size-bandwidth-efficiency trade-off situation.

SUMMARY OF THE INVENTION

It is an object of the invention to obtain a portable radio communication device having antenna means in which the available space can be better utilised, making it possible either to decrease the space needed for the antenna elements or to improve the antenna performance, or both.

It is also an object of the invention to obtain a portable radio communication device having antenna means, having a transmitting antenna and a receiving antenna, where the radiative coupling between the antennas is minimised.

Another object of the invention is to obtain a portable radio communication device having antenna means in which it is possible to use antenna types which give lower losses in human tissue (i.e. exposing a user to lower electric near field) in combination with sufficient performance when applied in a regular phone geometry.

A further object of the invention is to obtain a portable radio communication device having antenna means in which it is possible to use antenna elements which, by a balanced construction, has less interaction with the telephone body and thus less negative influence on the efficiency of the antenna, when the telephone is in talk position.

These and other objects are attained by a portable radio communication device comprising a housing, antenna means for transmitting and receiving RF signals, transmitting and receiving circuits arranged in the housing, at least a conductive portion, a power source, and a user interface. The antenna means includes a first antenna, being a transmitting antenna, and connected to the receiving circuits. The first and second antennas having orthogonal radiating characteristics in relation to each other.

The portable radio communication device having at least one of the first and second antennas of a magnetic dipole type, or at least one of the first and second antennas is a magnetic dipole loop antenna.

Additionally, the portable radio communication device has at least one of the first and second antennas encompassed by the housing of the radio communication device.

The first and second antennas are arranged to be encompassed by a housing of the radio communication device, and at least one of the first and second antennas includes at least a portion of the conductive portion of the radio communication device.

Also, one of the first and second antennas is of the electric dipole type and the other of the first and second antennas is of the magnetic dipole type.

The magnetic dipole essentially is arranged to be directed parallel with a surface of the housing of the radio communication device being in contact with the head of the user, when in use, so that the magnetic dipole essentially is directed parallel with the skin of the user at a region around the surface.

Alternatively, the magnetic dipole essentially is directed perpendicular to a surface of the housing of the radio communication device being in contact with the head of the user, when in use, so that the magnetic dipole essentially is directed perpendicular to the skin of the user at a region around the surface.

The first and second antennas are of the same electric/magnetic type but directed approximately 90° apart resulting in different polarisation.

The first and second antennas physically are included in the same part but giving two antenna functions by different feeding.

A third antenna function is included for diversity reception.

The first antenna is of a magnetic dipole type, and arranged to be located at an end portion, preferably the top portion, of the radio communication device. The second antenna includes an electric dipole constituted of a portion of the radio communication device, and the second antenna also includes the first antenna acting as a portion of the electric dipole.

In another embodiment, the first antenna is of a magnetic dipole type, and the second antenna is of a magnetic dipole type.

Alternatively, the first antenna is of an electric dipole type, and the second antenna is of an electric dipole type.

In the portable radio communication device, the antenna (s) of a magnetic dipole type includes a loop formed like an 8 on a substrate. One half of the loop is arranged on one side of the substrate, and the other half of the loop is arranged on the other side of the substrate. The two halves of the loop are connected to each other through holes in the substrate, and the loop is arranged to be fed at central feeding portions.

The portable radio communication device wherein the antenna(s) of a magnetic dipole type includes a loop formed on a ferrite core.

The portable radio communication device wherein at least one of the first and second antennas includes a small supporting structure.

The portable radio communication device wherein the housing is a small supporting structure.

The portable radio communication device wherein means are provided for tuning the first and second antennas to multiple frequency bands.

It is also an object of the invention to obtain an antenna system in which the available space can be better utilised, making it possible either to decrease the space needed for the antenna elements or to improve the antenna performance, or both.

It is also an object of the invention to obtain an antenna system, having a transmitting antenna and a receiving antenna, where the radiative coupling between the antennas is minimised.

Another object of the invention is to obtain an antenna system in which it is possible to use antenna types which give lower losses in human tissue (i.e. exposing a user to lower electric near field) in combination with sufficient performance when applied in a regular phone geometry.

A further object of the invention is to obtain an antenna system in which it is possible to use antenna elements which, by a balanced construction, has less interaction with a telephone body and thus less negative influence on the efficiency of the antenna, when the telephone is in talk position.

These and other objects are attained by an antenna system for transmitting and receiving RF signals from and to a portable radio communication device. The system comprising a first antenna, being a transmitting antenna, and being connectable to receiving circuits of the radio communication device, a second antenna, being a receiving antenna, and being connectable to receiving circuits of the radio communication device, wherein the first and the second antennas have orthogonal radiating characteristics in relation to each other.

The antenna system wherein at least one of the first and second antennas is of a magnetic dipole type.

The antenna system wherein at least one of the first and second antennas is a magnetic dipole loop antenna.

The antenna system wherein at least one of the first and second antennas is arranged to be encompassed by a housing of the radio communication device.

The antenna system wherein the first and second antennas are arranged to be encompassed by a housing of the radio communication device, and at least one of the first and second antennas includes at least a portion of the conductive portion of the radio communication device.

The antenna system wherein one of the first and second antennas is of the type electric dipole and the other of the first and second antennas is of the type magnetic dipole.

In one embodiment, the antenna system wherein the magnetic dipole essentially is arranged to be directed parallel with a surface of the housing of the radio communication device being in contact with the head of the user, when in use, so that the magnetic dipole essentially is directed parallel with the skin of the user at a region around the surface.

In an alternative embodiment, the antenna system wherein the magnetic dipole essentially is directed perpendicular to a surface of the housing of the radio communication device being in contact with the head of the user, when in use, so that the magnetic dipole essentially is directed perpendicular to the skin of the user at a region around the surface.

The antenna system wherein the first and second antennas are of the same electric/magnetic type but directed approximately 90° apart resulting in different polarisation.

The antenna system wherein the first and second antennas physically are included in the same part but giving two antenna functions by different feeding.

The antenna system wherein a third antenna function is included for diversity reception.

The antenna system wherein the first antenna is of a magnetic dipole type, and arranged to be located at an end portion, preferably the top portion, of the radio communication device. The second antenna includes an electric dipole constituted of a portion of the radio communication device, and the second antenna also includes the first antenna acting as a portion of said electric dipole.

The antenna system wherein the first antenna is of a magnetic dipole type, and the second antenna is of a magnetic dipole type.

The antenna system wherein the first antenna is of an electric dipole type, and the second antenna is of an electric dipole type.

The antenna system wherein the antenna(s) of a magnetic dipole type includes a loop formed like an 8 on a substrate, one half of the loop is arranged on one side of the substrate, the other half of the loop is arranged on the other side of the substrate, the two halves of the loop are connected to each other through holes in the substrate, and the loop is arranged to be fed at central feeding portions.

The antenna system wherein the antenna(s) of a magnetic dipole type includes a loop formed on a ferrite core.

The antenna system wherein at least one of the first and second antennas includes a small supporting structure.

The antenna system wherein the first and second antennas are arranged to be mounted to a small supporting structure.

The antenna system wherein the antenna system is provided means for tuning the first and second antennas to multiple frequency bands.

The portable radio communication device wherein it is provided with an antenna system.

By the arrangement of orthogonal transmitting and receiving antennas, it is achieved an antenna system is achieved having a minimised coupling between the transmitting and receiving antennas. Antenna elements suitable for obtaining orthogonal radiating characteristics are often symmetrical.

The mobile phones of today are very different and are designed in different ways, and thus different solutions will be optimal in different cases. It is one object of the invention to adapt the antennas to different phones by different choices among the possibilities.

In order to use an antenna regardless of its type on a portable (cellular) phone it is necessary to use an antenna which is small and which will have desired function when it is located on a small supporting structure (i.e. shorter than $\lambda$ as discussed above).

By using two antennas, one for receiving and one for transmitting, it will be possible to optimise each antenna separately each for its demands, and a reduction of the mutual coupling will be obtained, decreasing the demand for duplexing function.

By using antennas with orthogonal radiation characteristics, the mutual coupling between transmitter and receiver will be reduced further, and in many cases eliminating the need for duplexing circuits. The orthogonal antennas will in many cases reduce the need for space as two orthogonal antennas may occupy the same space without interference.

By the use of magnetic dipoles type antennas an antenna having significantly lower losses in human tissue than an electrical dipoles is obtained.

Magnetic dipoles used with their axis parallel to the skin of the user have a positive interaction with the user which increases its bandwidth while still having considerable less SAR than a corresponding electrical dipole.

Magnetic dipoles used with their axis perpendicular to the skin of a user have very low SAR but during identical conditions less bandwidth than one with the axis parallel to the skin.

One consequence of the space efficient solution is that many solutions based on the invention are easy to hide inside of the housing of the phone. The hiding of the antenna is of big interest from exterior design aspects.

By integrating parts of the antenna in the housing available space can be utilised better, further increasing the possibilities to combine good antenna function with a good exterior design of the phone housing.

The combination of one electric dipole (similar to the antennas on typical commercial phones of today) and one magnetic dipole type antenna is compatible to the design of most phones and enables low losses in human tissue and efficient antennas.

A straightforward solution to obtain orthogonal radiation properties is to use two crossed fields which can be either electric or magnetic.

To save space it is a general desire to use the same space for both antennas and one solution for that is to use the same antenna element fed in two different ways to give orthogonal fields.

One object of the invention is to minimise the interaction with the user but nevertheless it is advantageous to keep the antenna away from the grip of the user's hand which is accomplished by locating the antenna preferably in the upper end of the phone.

By using a magnetic dipoles type antenna it is achieved an antenna having low interaction with the user.

Electric dipoles are more generally easier to match but it is possible to obtain lower losses in human tissue by eliminating currents along the phone for the transmitting antenna. This can be achieved by the arrangement of an electrical dipole transmitting antenna arranged horisontally.

By using a more complex tuning network and utilising the better radiating characteristics at higher frequencies it is possible to combine multi band service with the original size of a magnetic loop antenna.

DESCRIPTION OF PREFERRED EMBODIMENTS

Figure 1A:
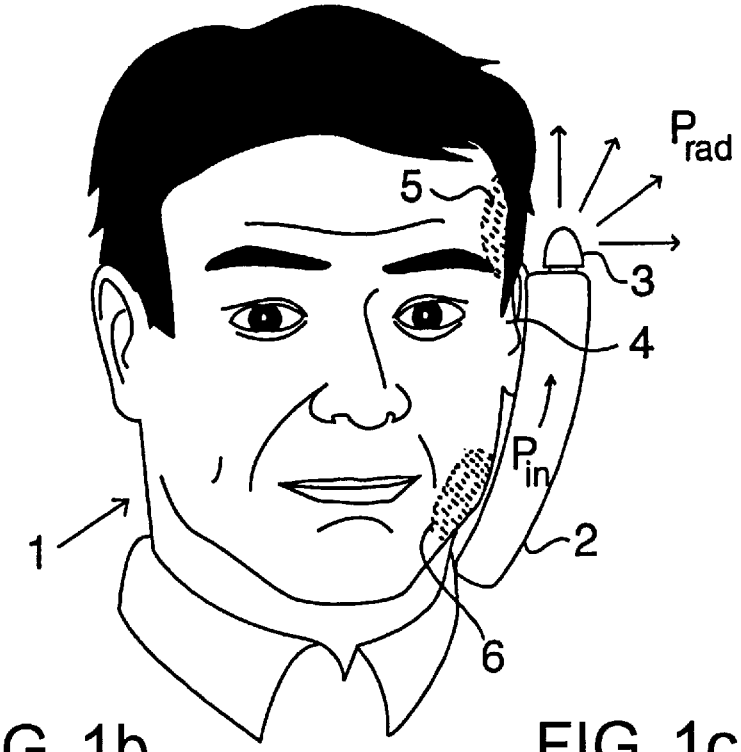
FIG. 1a (PRIOR ART)
FIG. 1*a* shows in diagrammatical view a typical known telephone with a helical antenna, held to the head of a user.
Figure 1B:
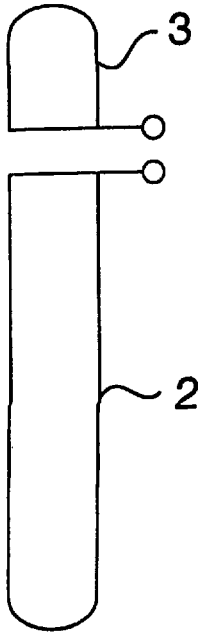
FIG. 1b (PRIOR ART)
FIG. 1*b* shows in diagrammatical view a very asymmetric electric dipole.
Figure 1C:
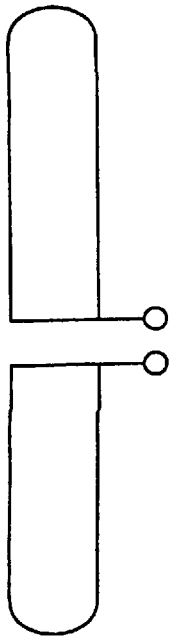
FIG. 1c (PRIOR ART)
FIG. 1*c* shows in diagrammatical view a common symmetric dipole.
Figure 2A:
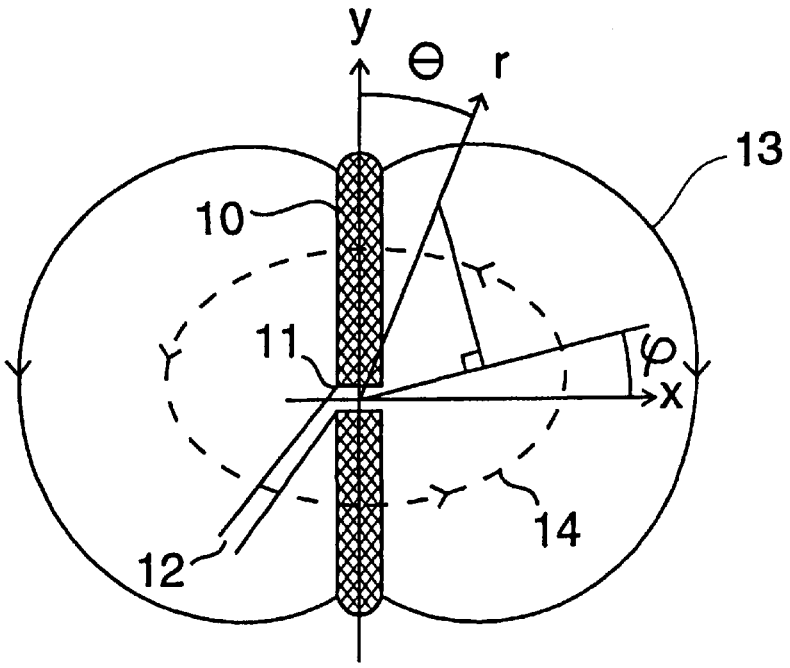
FIG. 2a (PRIOR ART)
FIG. 2*a* illustrates diagrammatically the fields of an electric dipole.
Figure 3A:
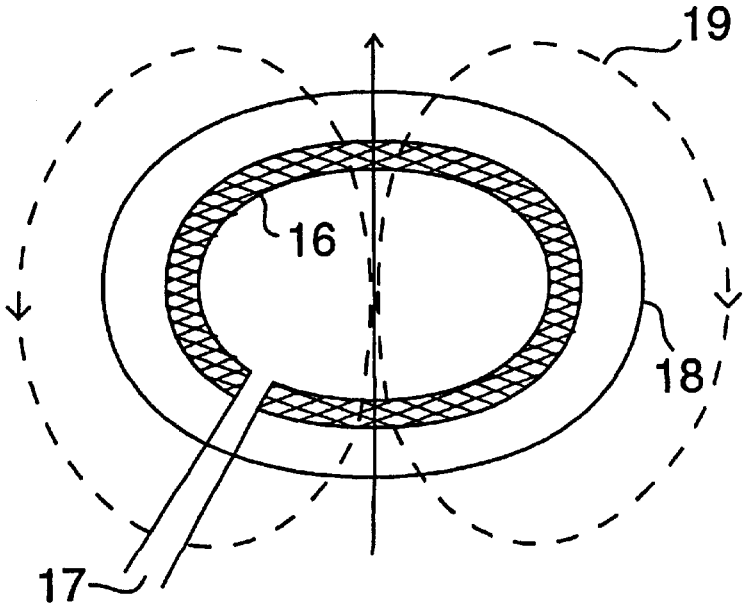
FIG. 3a (PRIOR ART)
FIG. 3*a* illustrates diagrammatically the fields of an magnetic dipole.
Figure 2B:
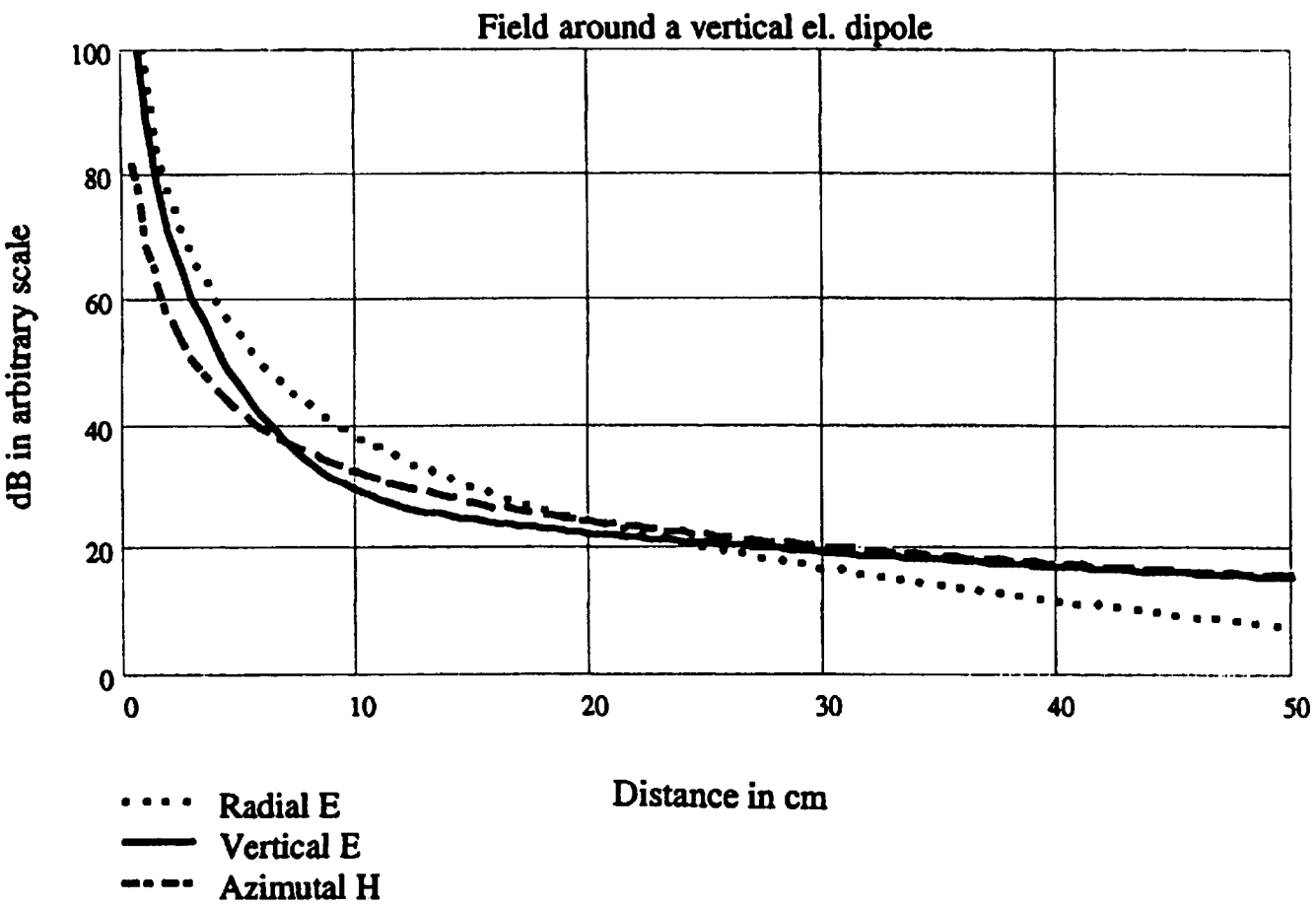
FIG. 2b (PRIOR ART)
FIG. 2*b* shows a diagram showing the how the fields depend on the distance from an electric dipole.
Figure 3B:
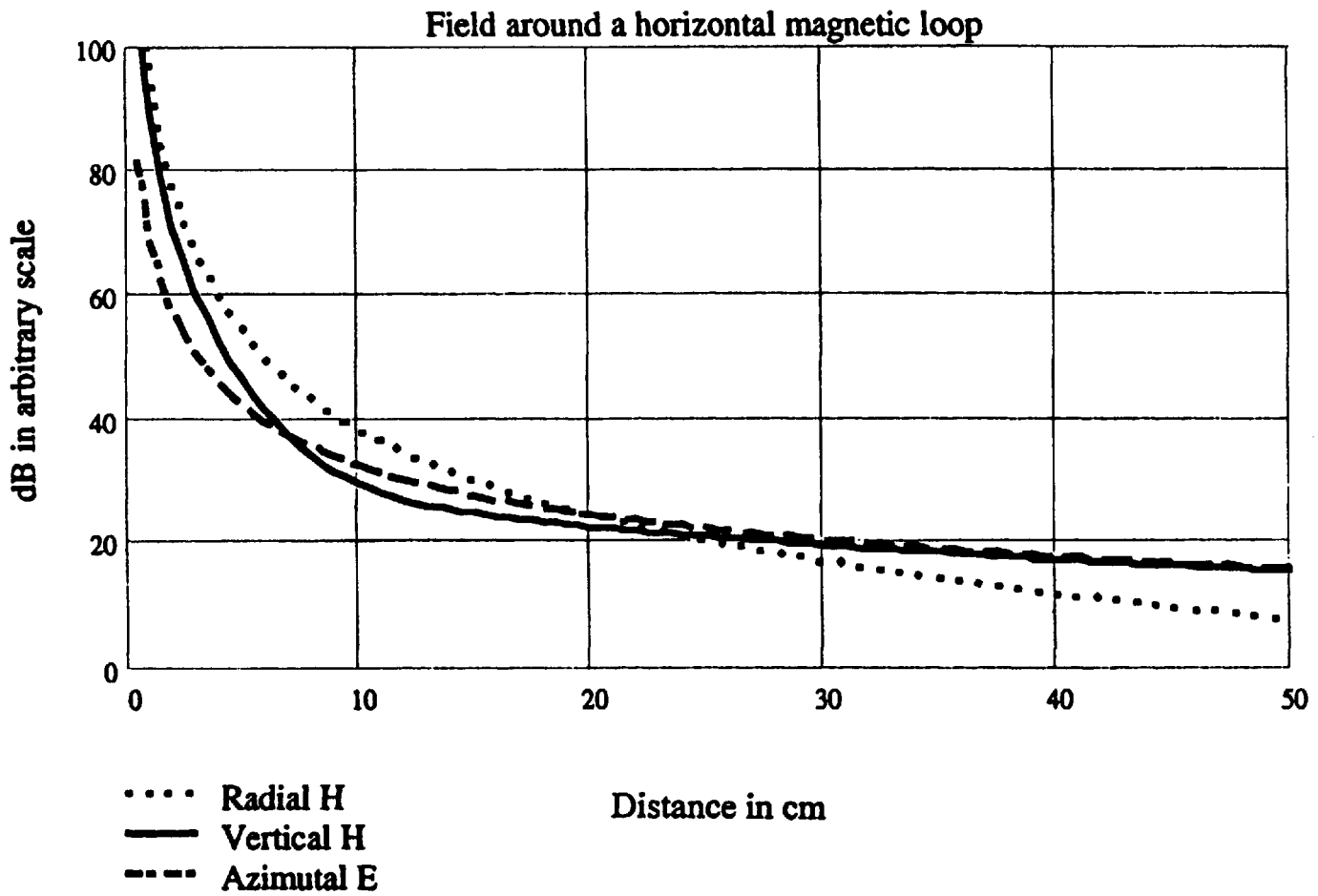
FIG. 3b (PRIOR ART)
FIG. 3*b* shows a diagram showing the how the fields depend on the distance from a magnetic dipole.
Figure 4:
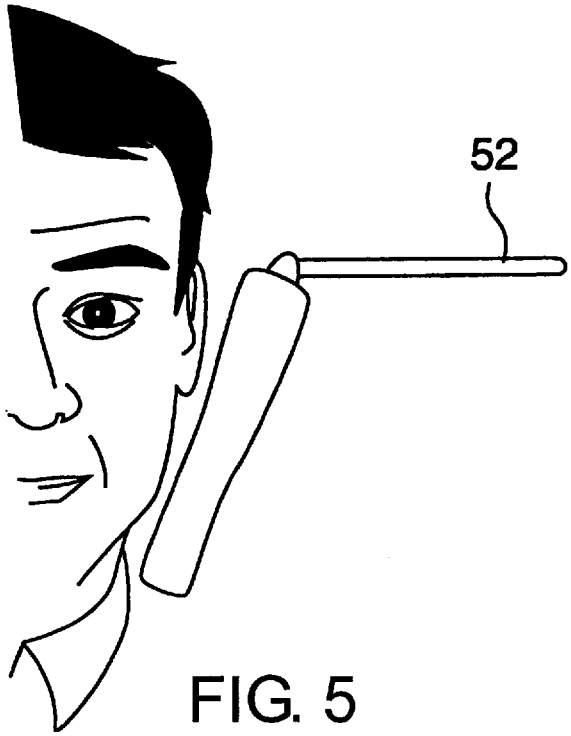
FIG. 4 (PRIOR ART)
FIG. 4 shows one example of a known radio communication device having an antenna, which can be bent.
Figure 5:
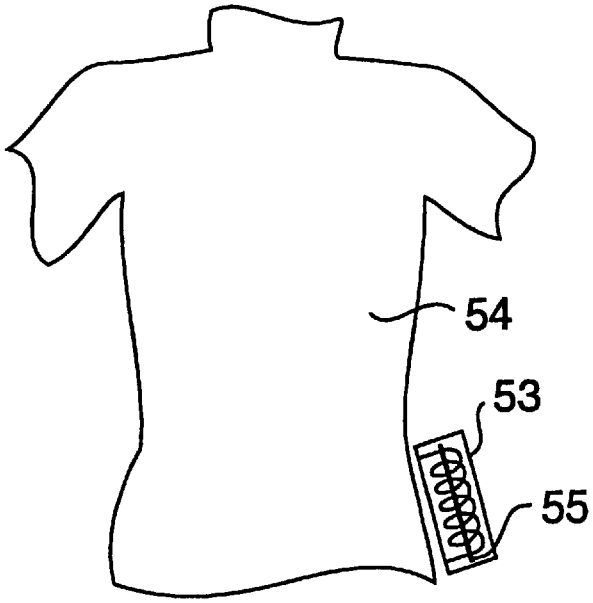
FIG. 5 (PRIOR ART)
FIG. 5 is a diagrammatic of a typical pager attached adjacent to the waist of a user, and fitted with a ferrite core acting as a magnetic dipole as receiving antenna.
Figure 6:
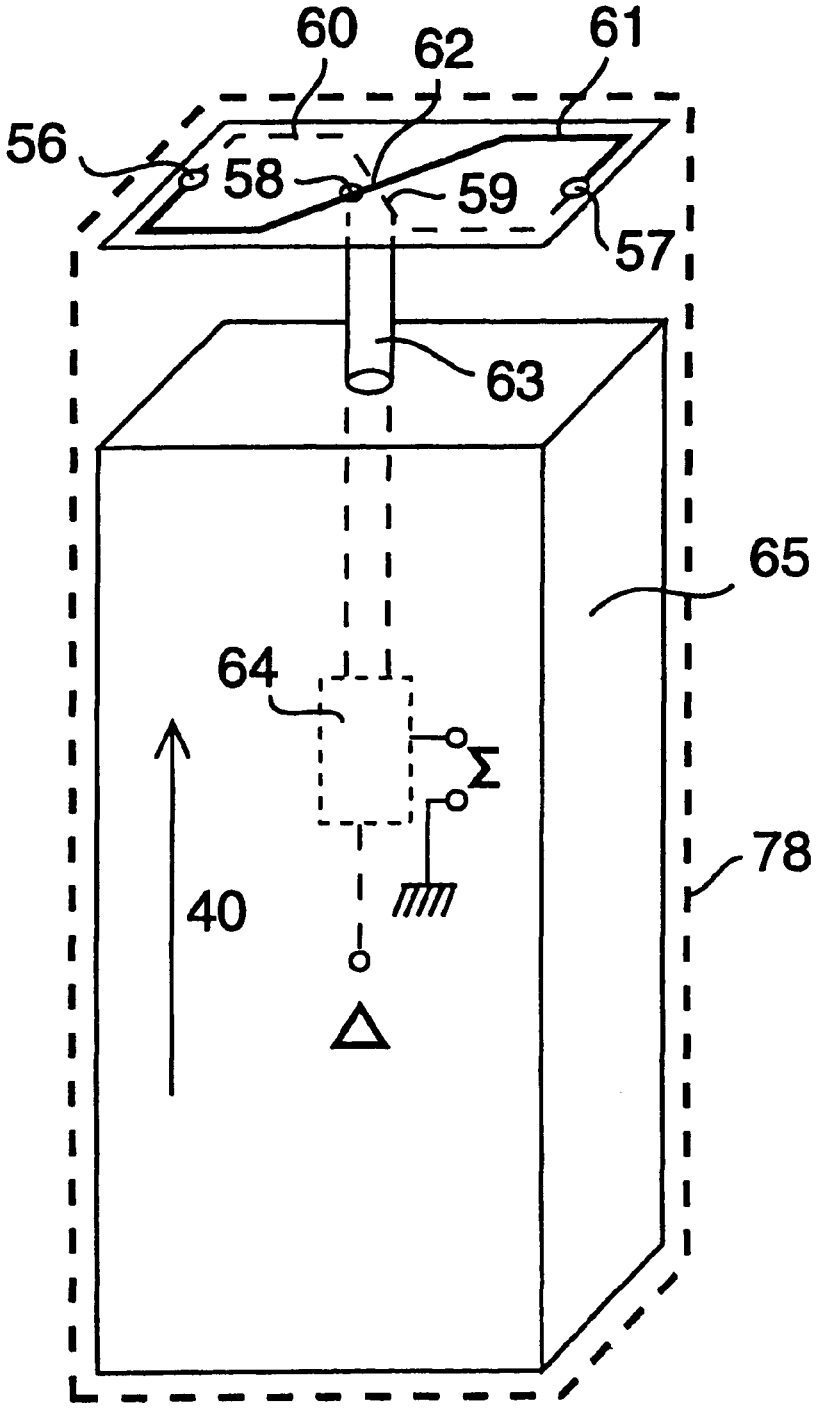
FIG. 6 is a diagrammatic view of a mobile radio communication device with an antenna system according to a first embodiment of the invention.

The embodiment of the present invention shown in FIG. 6 concerns an antenna system for a mobile radio communication device. According to the invention the transmitting and the receiving antenna functions are separated, and are performed by a transmitting antenna and a receiving antenna, respectively. The separation makes it possible to reduce their respective bandwidths with 55–60% (figures for GSM) compared with transmitting/receiving antennas used today. The receiving antenna may use the same radiation mode as is commonly used by phones today, but the transmitting antenna uses a magnetic dipole (loop) also directed along the phone. In FIG. 6*a* portable telephone body 65 is provided with a loop 60–61 in its top, preferably built in, inside the telephone housing. In order to obtain a balanced feeding, a loop shaped like an 8 is used, since ordinary loops (circular) are difficult to feed in a balanced way. In principle it is in resonance, which can be achieved when the length of the circumference of the loop is one wavelength. By the 8-shape with crossing conductors at 62, the currents are flowing in one direction around the loop as seen from the outside. One implementation of the loop with its crossing is to print it on a two-sided circuit board or film, with one half of the 8-loop on each side. The two halves of the 8-loop are connected through holes 56, 57 in the circuit board or film. Obviously when to be used in a phone the circumference of the loop can not be one wavelength long. However, by introducing a capacitance between the sides of the circuit board or film at the crossing 62, it can easily be tuned to resonance when made shorter so as to fit in to a telephone. This can be achieved by enlarging a portion of the conductors, on each side of the circuit board or film, at the crossing 62. The 8-loop is fed by a balanced line 63 which in turn is fed from a standard 180°-hybrid network 64 or (a balun with symmetric output beside an antisymmetric). The hybrid 64 is a 4-port where two ports are connected to the line 63. Signal on the Δ-input gives feeding to the transmission line 63 and thus to the 8-loop 60–61, at points 58 and 59, respectively. The potential difference between the points 58 and 59 causes circulating currents in the 8-loop. A signal on the Σ-input gives the same current (same magnitude and same direction) in the both wires of the transmission line 63 and will thus not give a circulating current in the 8-loop. Since one connection on the Σ-input is connected to the phone body or signal ground the loop 60–61 and the telephone will act as an electric dipole. The direction of the electric dipole is indicated by the arrow 40. This feeding of the telephone body is made in a very similar way to a typical phone of today as discussed above. In this embodiment the Σ-connection is to be connected to the receiver circuits of the telephone. Thus the electric dipole described acts as a receiving antenna, and the operation is reversed to the transmitting antenna operation, and the whole loop structure will be used as one end of an unsymmetric electric dipole and the phone itself will be used as the other end.

Figure 7:
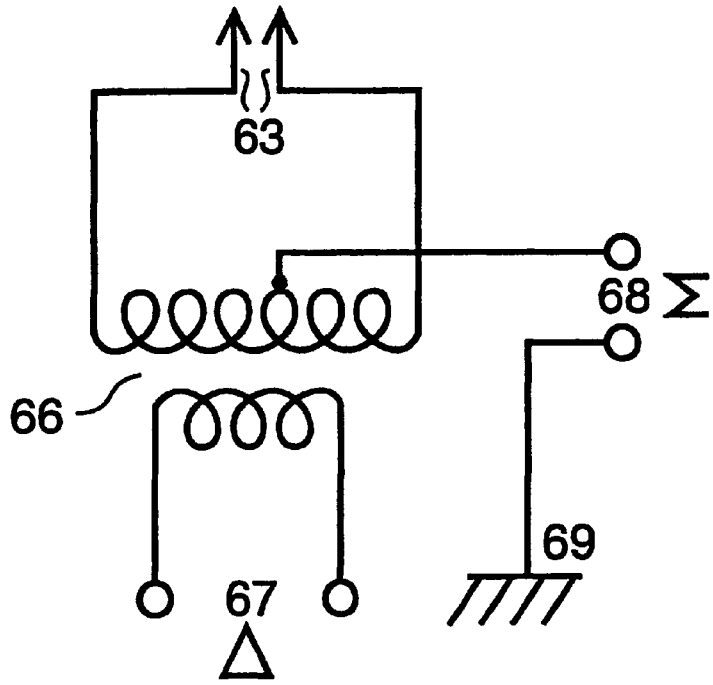
FIG. 7 is a diagrammatic view of a hybrid network used in connection to some embodiments of the invention.
Figure 8:
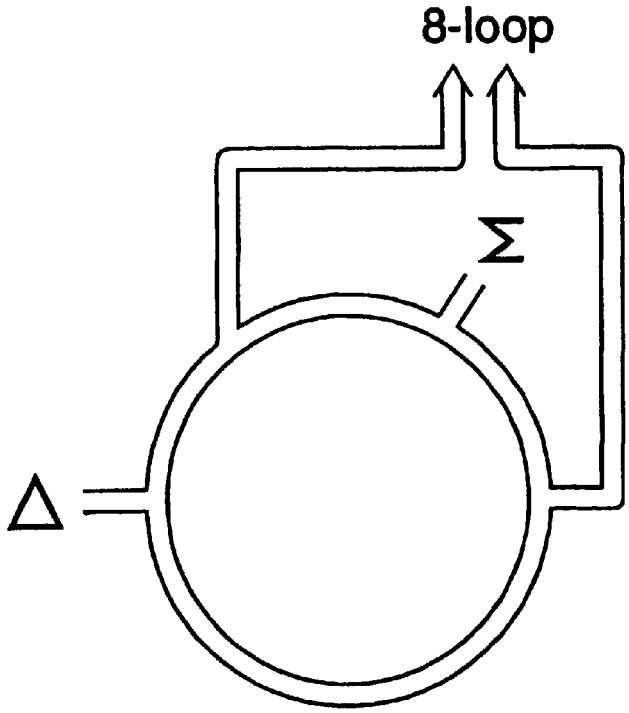
FIG. 8 is a diagrammatic view of a 180° hybrid ring used in connection to some embodiments of the invention.

The hybrid network 64 can be made in many ways, but is most easily described as a differential transformer as shown in FIG. 7. A transformer 66 (which is a few mm large at 900 MHz) has one transmitter input 67 feeding the line 63 and one receiver output 68 which is connected to the centre of the transformer and to the telephone chassi 69 (or signal ground). Johnson, Antenna Engineering handbook (McGraw Hill 1993) gives a number of other solutions among them the 180° hybrid ring (rat-race), which shown in FIG. 8, and which is well suited for printing. It comprises a ring 73, which has a circumference of nominally 1.5 wavelengths, and has 4 connections spaced a quarter of a wavelength from each other, leaving ¾ of a wavelength without connections, as indicated in the figure. This hybrid ring is used in the same way as the network 64 shown in FIG. 7.

As shown in FIG. 6, the magnetic loop 60–61 is arranged essentially in a plane substantially perpendicular to a centre axis of the telephone body. It is also arranged so that the centre axis 75 of the magnetic loop is essentially parallel with the front and back surfaces of the telephone body. By this orientation, the transmission from the magnetic loop is supported by the presence of the user, which improves its efficiency, which will be explained further below. This support from the user in combination with the reduced requested bandwidth makes it possible to use a loop antenna to obtain better efficiency in "talk position" than the typical antennas in use today. Up to now, loop antennas have been considered as having too narrow bandwidth for use in phone systems. As a logical consequence of the use of the magnetic dipole the SAR goes down considerably as compared to a standard type small antenna.

When the loop is formed by a pattern on a flexible film, it is advantageous that the same film supports the transmission line downwards to the electronics of the telephone. Also the balun or the 180° hybrid can be formed on the same film.

By the arrangement of the antennas in the embodiment of FIG. 6, the transmitting and receiving antennas will have orthogonal radiating characteristics, in relation to each other. This means that the coupling between the antennas will be very small (theoretically none).

Referring to FIG. 6, the housing includes a user interface such as a display, punch buttons etc. Further the telephone body includes a printed circuit board containing transmitting and receiving circuits. In the phone body or the enclosure a battery is included to make the unit self supporting. The printed circuit board, possibly including screening covers is a conductive portion which can be a part of the antenna. Also the housing can be conductive and act as a part of the antenna. The telephone body can also include a metallic frame or chassi, which can form a part of the antenna. A battery, making the telephone usable without connecting wires can be arranged in the housing 78 or the telephone body 65.

Typically for a telephone described, is that both the antenna element and the telephone body are small, as a contrast to other antennas to be mounted on a ground plane. Here, the meaning of a small antenna element, is an antenna element being essentially smaller than one wavelength. The telephone body in such a case is a small supporting structure, which means that its biggest measure is essentially smaller than one wavelength.

Figure 9:
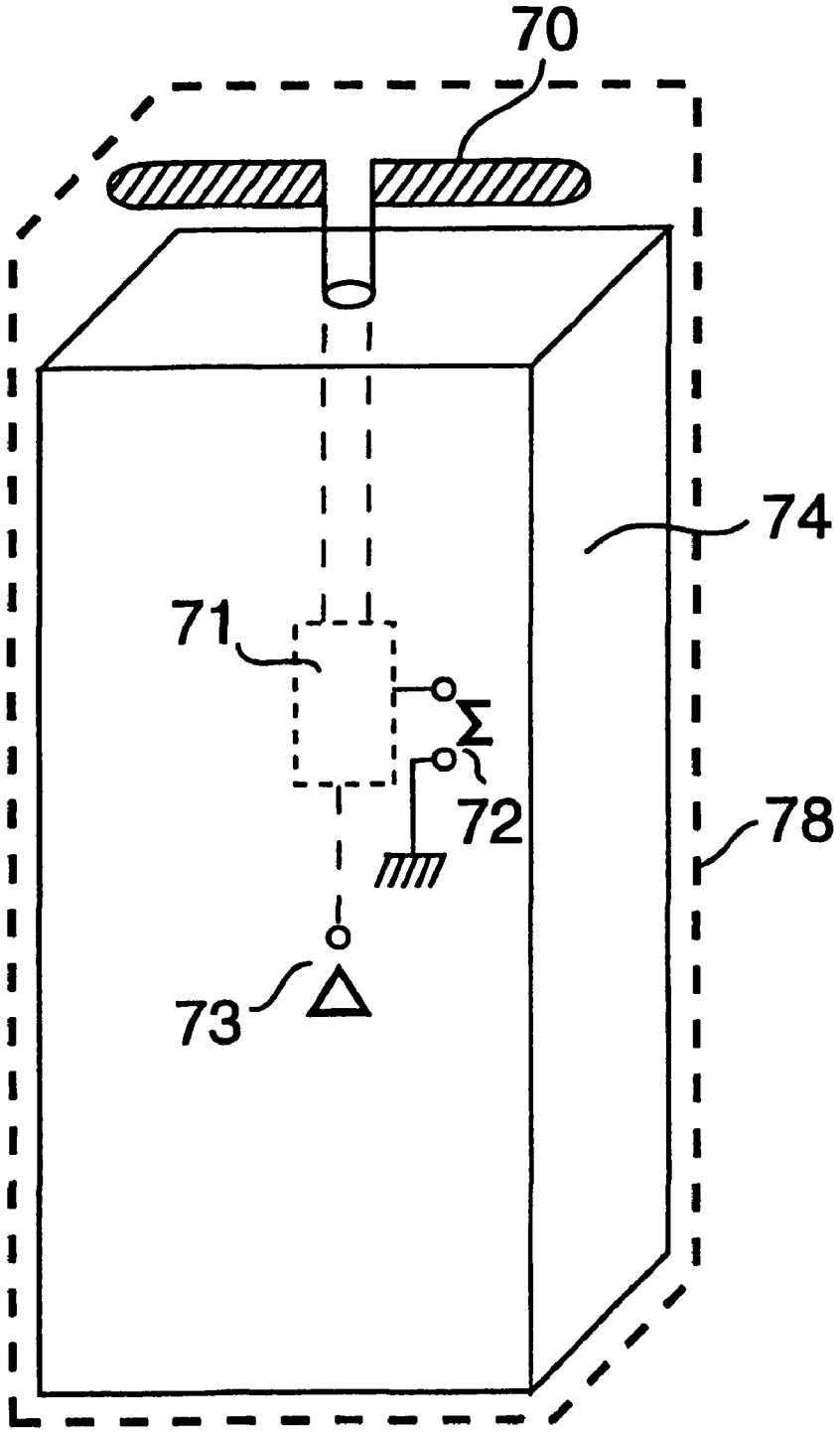
FIG. 9 is a diagrammatic view of second embodiment, according to the invention.

A second embodiment and a simple way to implement the invention, as far as the coupling between the transmitting and receiving antennas concerns, is shown in FIG. 9. A symmetric electric dipole 70 is provided in the top of the telephone, preferably inside the housing 78. By feeding the dipole in different modes it will be included in two separate and orthogonal antennas. The horizontal electric dipole 70 is coupled to a differential transformer 71 which is a standard component as shown in FIG. 7. The transmitting antenna is fed via the Δ-input 73 and the transformer. The dipole is thus fed symmetrically, and is thereby isolated from the telephone body, which will decrease the losses in human tissue. The connection 72 to the centre of the output winding of the transformer 71 is connected to the receiver which is also connected to the phone body. The receiving antenna is thus very similar to the typical antenna of modern phone radiating in the vertical electric dipole mode. This antenna will improve transmitter to receiver insulation, and losses in human tissue will be lower than that of other electrical dipoles.

Figure 10:
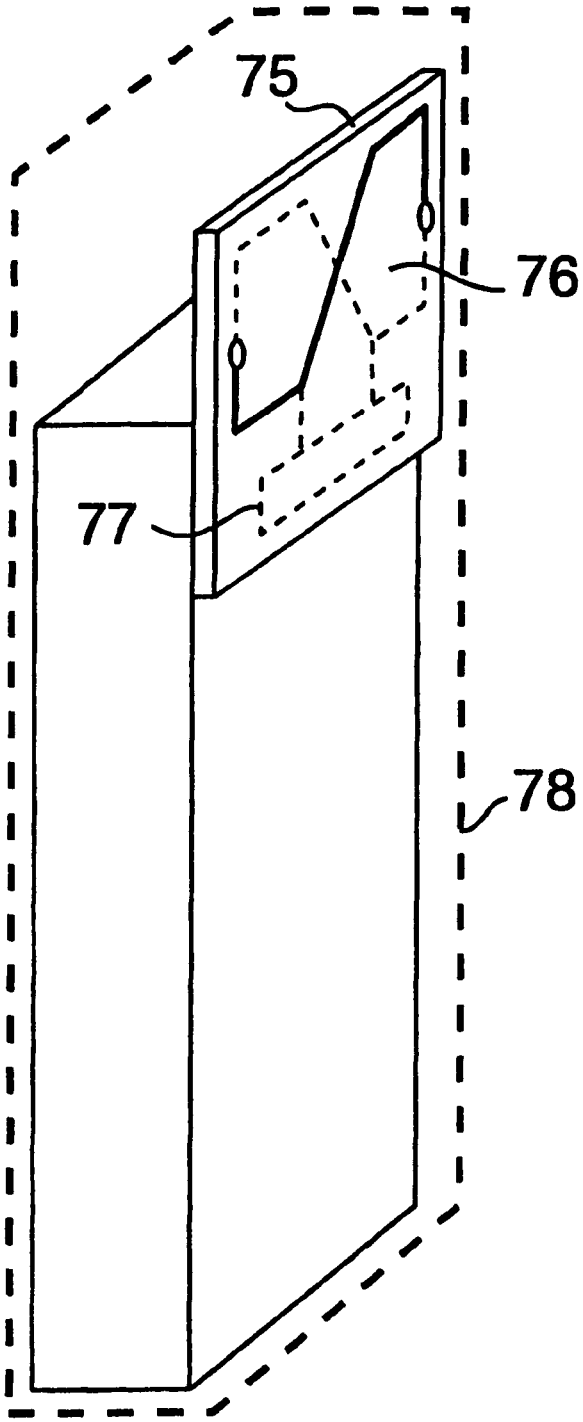
FIG. 10 is a diagrammatic view of third embodiment, according to the invention.

A third embodiment of the invention, which will give very low losses in human tissues, but will have a decreased bandwidth, is shown in FIG. 10. The hardware is similar to that of the embodiment shown in FIG. 6, but the 8-loop is turned 90° so that it will lie in a vertical plane, essentially parallel with the back of the telephone housing. A printed circuit board 75, which may be flexible, is provided with the 8-loop 76 and the 180°-hybrid circuits 77, and is located at the back side of the phone to increase the distance from the user. The circuit board is included inside the enclosure 78 of the phone.

The magnetic dipoles described above are accomplished by the 8-loop, but alternatively different kinds of loops or coils are possible to use provided that they are fed in a balanced way and are space-efficient. Loops divided in 3 or 4 sectors (clover-leaf antennas) are used and might also be used here. With suitable symmetry also a single loop can be used. The loop is one of the implementations of a magnetic dipole antenna but obviously other types are possible. A slot antenna in a ground plane is one common type of magnetic dipole antennas but applied on a phone the big difference between a "big structure" and a "small supporting structure" becomes obvious as a slot antenna will act both as a magnetic dipole antenna and as a feeder to an electrical dipole formed by the phone body and with typical telephone measures the second antenna will strongly dominate the radiation. It is also possible to use ferrite materials to make the magnetic dipole more efficient.

Figure 11:
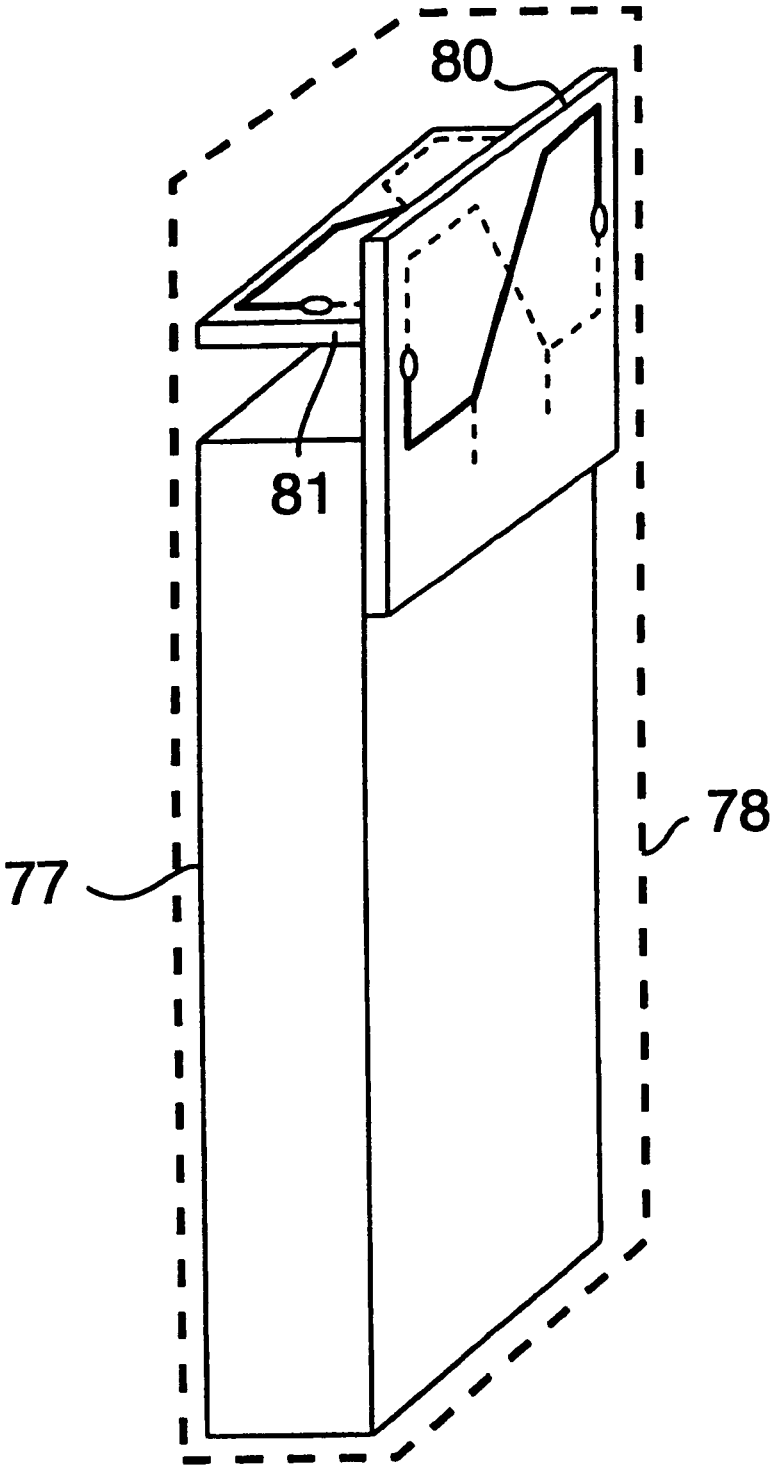
FIG. 11 is a diagrammatic view of fourth embodiment, according to the invention.

In a fourth embodiment of the invention two magnetic dipoles are used, as shown in FIG. 11. Two perpendicular loops are used and by a symmetric location the coupling can be small. No differential transformer or 180°-hybrid are necessary, since each loop has its input/output connected to the transmitter/receiver, respectively. Transmitter antenna 80 is located vertical (to give a horizontal magnetic dipole, giving the lowest losses in human tissue), while the receiving antenna 81 has a vertical direction of its dipole. None of them have a strong interaction with the phone body 77.

Figure 12A:
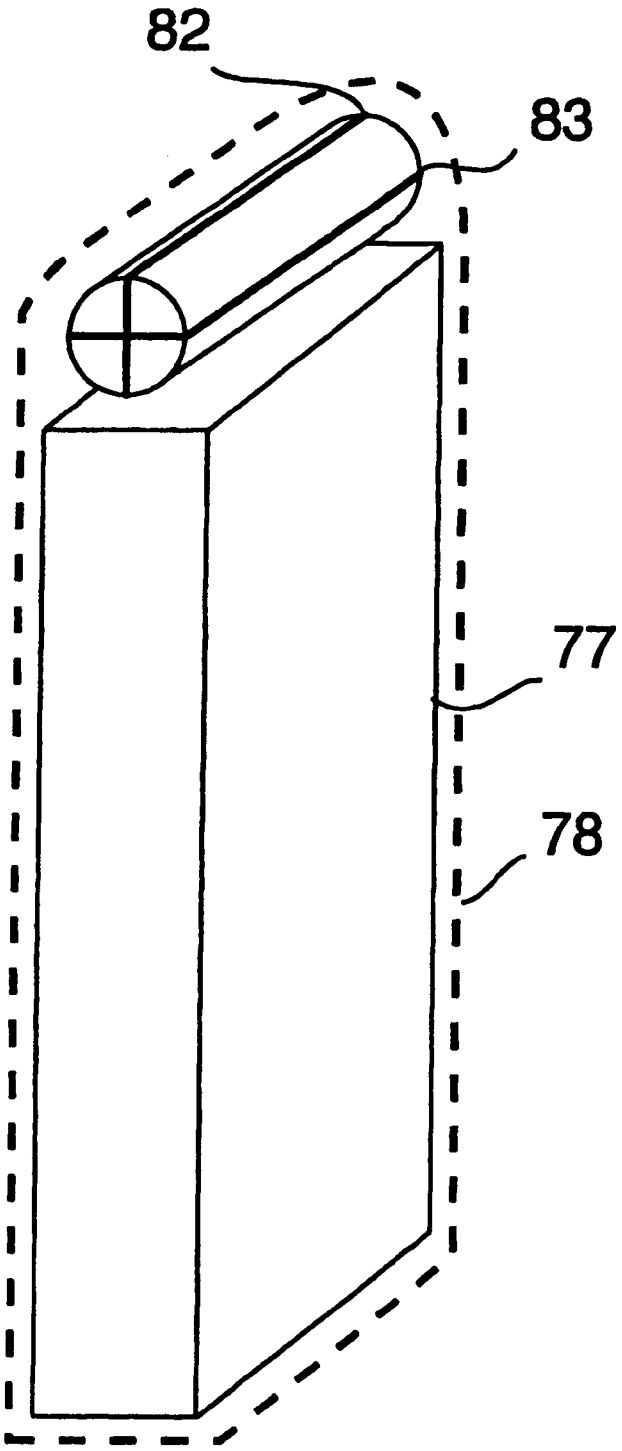
FIGS. 12*a–b* is a diagrammatic view of two variations of fifth embodiment, according to the invention.
Figure 12B:
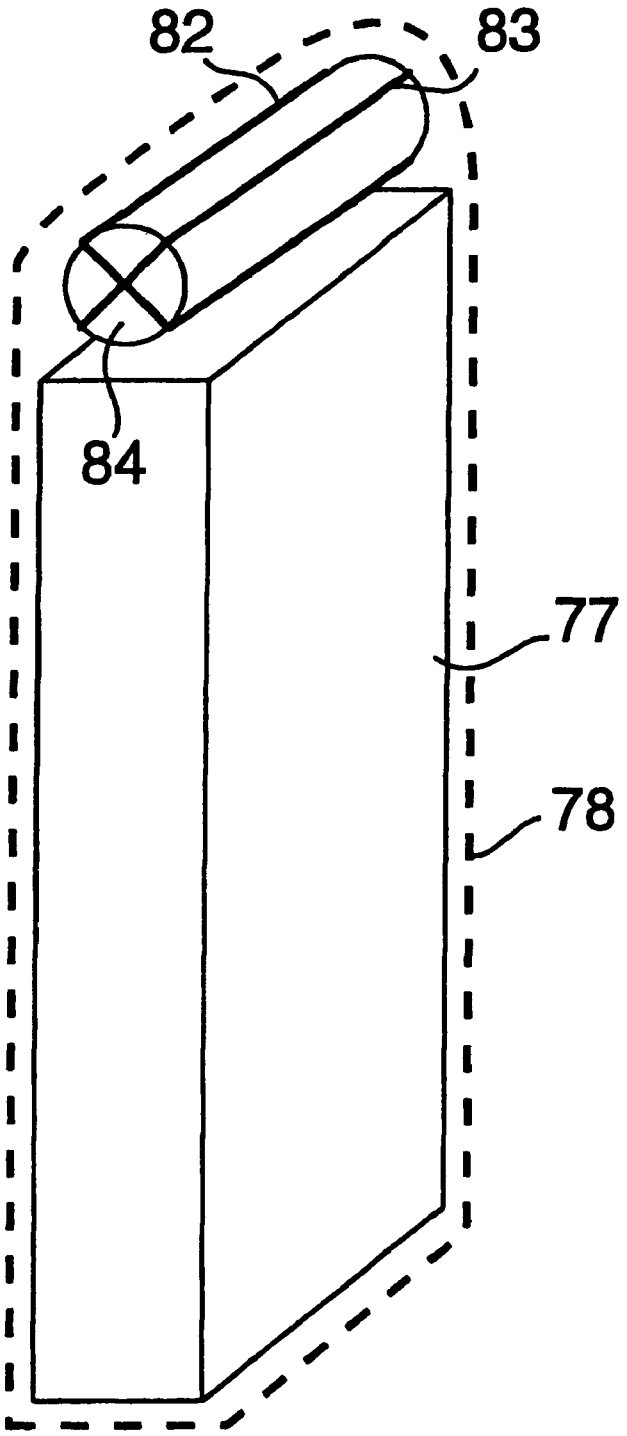

In a fifth embodiment of the invention, shown in FIGS. 12*a*–12*b*, similar to the fourth embodiment, a ferrite material is used to implement the two dipoles. With a good ferrite material this can decrease the volume as compared to FIG. 11 but the weight increases. The same ferrite core 82 is used for the two loops (windings) 83 and 84, which are used to get two antennas insulated from each other. It may be suitable to introduce a slight asymmetry to compensate for the influence of the phone body, to maintain low coupling. The two windings may be vertical/horizontal as in FIG. 12*a* or ±45° in relation to a horizontal plane, as in FIG. 12*b* to obtain symmetrical properties.

Figure 13A:
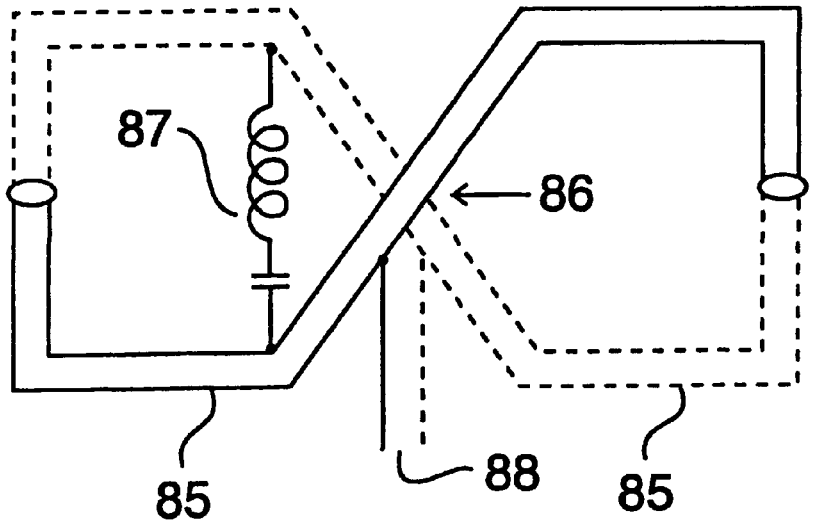
FIGS. 13*a–b* is a diagrammatic view of two variations of an arrangement for tuning a loop, according to the invention.
Figure 13B:
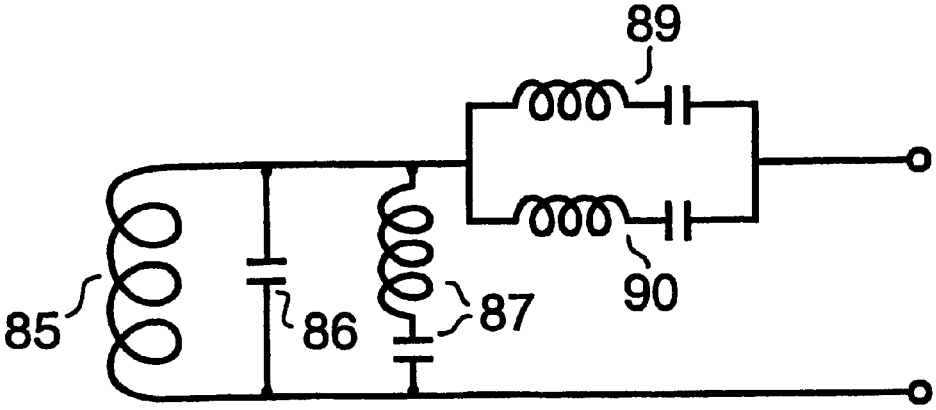

To simplify the description above, single frequency band operation has been assumed. The operation of the loop antenna(s) is by no means limited to that, and FIGS. 13*a*–13*b* gives an example. FIG. 13*a* shows the improved 8-loop where the inductance 85 (or $L_1$) is tuned to the lower frequency by the capacitance 86 (or $C_1$) created at the crossing. A serial resonance circuit 87 (with components $L_2$ and $C_2$) having a resonance frequency between 900 and 1800 MHz will act as a capacitor around 900 MHz and as an inductor around 1800 MHz. By suitable choice of components tuning at 900 MHz as well as 1800 MHz (or other frequencies) can be achieved. 88 denotes the feeding line and the inductance 85 ($L_1$) constitutes the radiating structure, and thus also the radiating resistance, which for a loop can be calculated as $20\,k^4A^2$ ohms, where k is the wave number ($=2\pi/\lambda$) and A is the area of the loop. This formula shows that the radiation resistance is much higher at 1800 MHz than at 900 MHz, which is very useful (advantageous) for maintaining good bandwidth at 1800 MHz, where the rather complicated tuning structure otherwise should decrease the bandwidth. FIG. 13*b* gives a schematic diagram where two more resonance circuits 89 and 90 have been added to improve bandwidth and to adjust the matching at the two frequencies. As known from circuit theory a tuning to two or more frequencies can be obtained in many ways but here it is desirable to use the full loop (85 in FIG. 13*a*) for all frequencies.

In the described embodiments, where Δ- and Σ-inputs/outputs are employed in the feeding, separate feeding lines from the transmitter circuits and receiver circuits, respectively, can be used. However, one transmission line can be used, connecting the transceiver circuits of the radio communication device with a duplexer, diplexer, or other coupling means, which in turn is connected to, and preferably arranged in connection with, the Δ- and Σ-inputs/outputs.

By separating receiving and transmitting antennas, the need for bandwidth can be reduced by 55–60% for the GSM system, as mentioned above. This can directly be translated to corresponding size reduction enabling the use of SAR efficient antennas.

Figure 14:
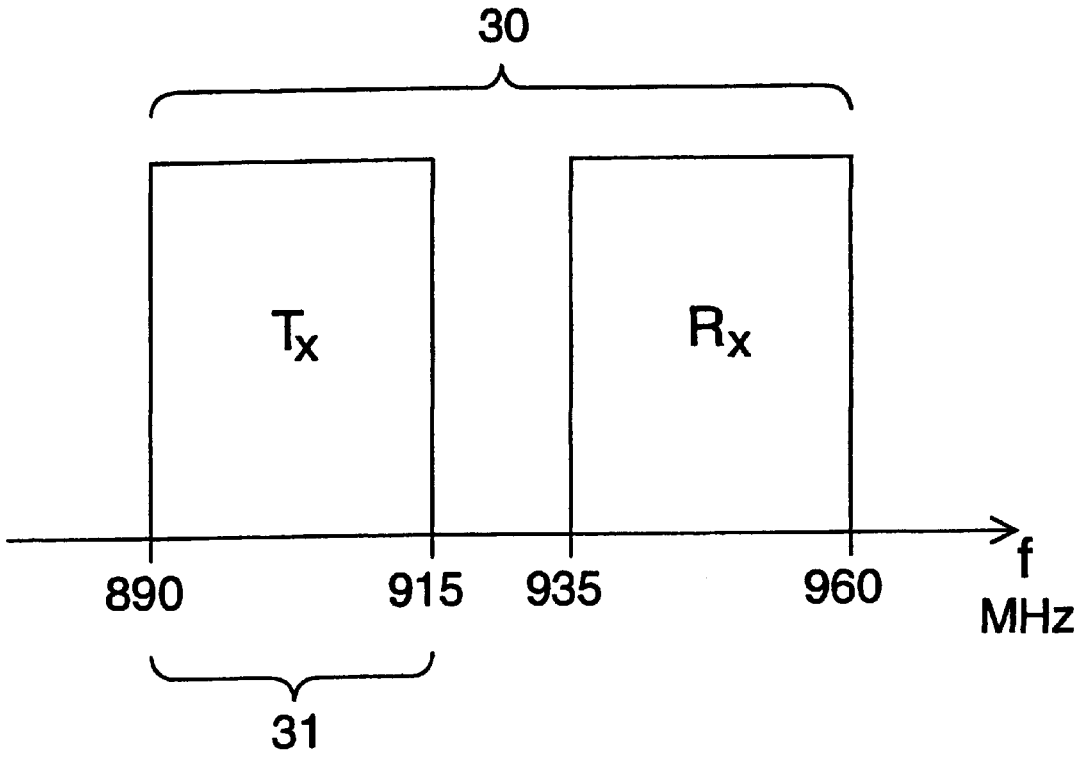
FIG. 14 shows the frequency division in the GSM system of today.

FIG. 14 shows the frequency division in the GSM system of today. 30 indicates the nominal bandwidth which is 7.6%, while the transmitter bandwidth 31 is 2.7%. A suitable choice of antenna and polarisation can make the interaction with the user more favourable and further decrease the need for size to obtain sufficient bandwidth-efficiency product. Other telephone systems (AMPS, UMTS etc) may have other frequencies but a reduction of the bandwidth requirements with more than 50% will occur in all cases.

In order to obtain separate antenna functions without power loss into the another antenna it is necessary to make the antennas distinctively different. This difference can be accomplished by different symmetry properties, different type of fields, different polarisation or different frequency ranges. Without at least one such difference there will be a leakage between the antennas having them to work together in spite of the "two antenna look" and there will be a power leakage between them. This difference is a basic concept in this invention and the term orthogonal is used to describe "distinctively different" in terms of the radiation field. Beside the radiating field, due to the orthogonality of the antenna elements, at least one of them will generally have a small bandwidth further decreasing coupling if unbalance caused by the hand etc. should have changed it a bit.

Two antennas being orthogonal means that the fields in their radiation pattern do not have any power radiation in common, which also means that there is no coupling between them in theoretical sense. The power radiated from an antenna A1 can be calculated as the integral of $|E_1|^2/Z_0$ over all angles at a long distance from the antenna (i.e. anywhere within the far field zone). The power radiated from an antenna A2 will in the same way be calculated as the same integral of $|E_2|^2/Z_0$. To say that the antennas are orthogonal now means that the corresponding integral of $|E_1E_2|/Z_0$ is zero far away from the antenna. The radiation from any antenna or radiating structure occupying a limited space can in mathematical sense be perfectly described as a sum of elementary electromagnetic radiation functions or radiation modes. It can be shown that if whole the structure can be enclosed in a sphere having an circumference of C wavelengths the number of radiating modes significantly contributing to the far field are approximately proportional to $C^3$. For a modern phone at 900 MHz C is close to 1 and the six basic modes (simple dipoles) will give an approximately description of the field but at the 1800 MHz bands C is around 2 and the field is more complicated. As will be recognised by anyone familiar with the concept, different linear combinations can be created from this set of radiation modes. When the term "orthogonal antennas" is used in this application, thus each of them can be best described as combinations rather than pure modes from a basic set, but with both of the antennas so constructed that they are orthogonal with respect to their radiation. Even if "orthogonal" basically is a mathematical concept it can very well be transformed to practical antennas. It should be noted that "orthogonal" is more than "being different". For instance, two antennas e.g. a helix and a PIFA, which is a used combination, are not orthogonal are not orthogonal as their far fields are practically the same i.e. similar to an electrical dipole along the phone. One practical detail is that "orthogonal" refers to free space conditions and changes may occur with head and hand included, resulting in that the above mentioned integral of $|E_1E_2|/Z_0$ will be small compared to the integrals of $|E_1|^2/Z_0$ and $|E_2|^2/Z_0$ rather than zero, but the antennas are still considered to be orthogonal.

The magnetic dipoles have a SAR which is an order of magnitude lower than the SAR of electric dipoles. The orientation also has an influence, but the important border line is between electric and magnetic dipoles.

Magnetic dipoles parallel to the local surface of the head of a user and electric dipoles perpendicular to the local surface of the head of a user are supported by the reflection in the surface of the head, which means that they are more efficient close to the head than in free space. "more efficient" may in practical implementation be depending on the matching circuits but with the reflection in the local surface included the radiation will increase which basically simplifies matching and bandwidth. In those cases where the reflection in the local surface counteracts the antenna a corresponding degradation or increased difficulty to match will occur. This is in contrast to magnetic dipoles perpendicular to the local surface of the head and electric dipoles parallel to the local surface of the head. In the last case efficiency goes down and SAR goes up as being kind of the complementary quantity to the radiation. In spite of this the magnetic dipole still has lower SAR than the electric.

Figure 15A:
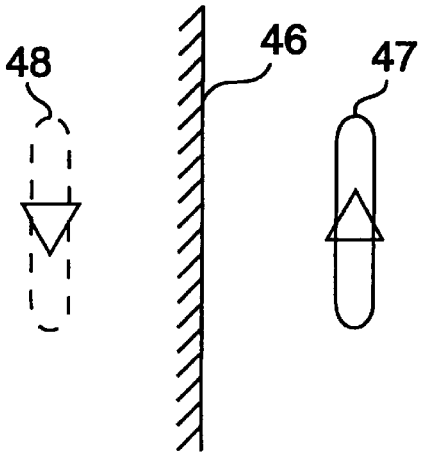
FIGS. 15*a–d* show different dipoles in different positions relative the local skin surface of a user.
Figure 15B:
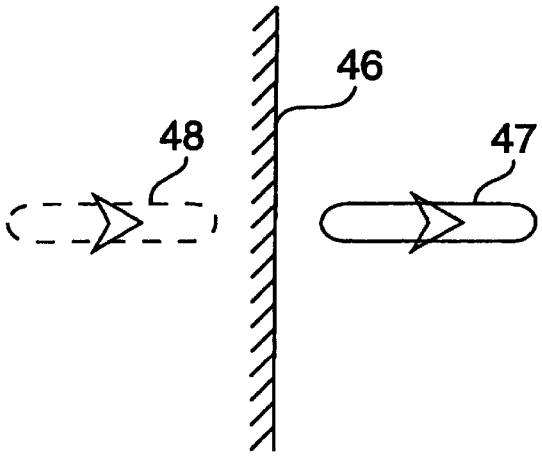
Figure 15C:
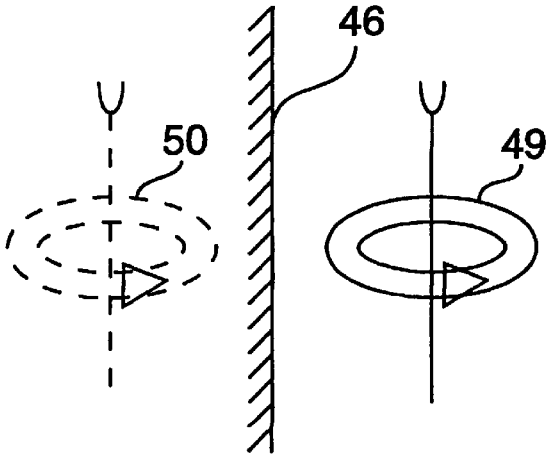
Figure 15D:
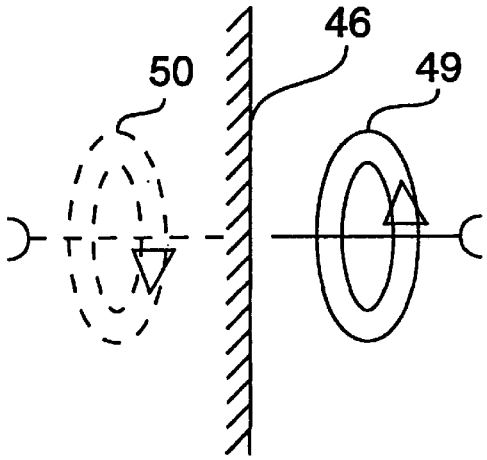

This can be illustrated by FIGS. 15*a–d* giving different dipoles in different positions relative the local skin surface of the user 46, the skin of which just here is supposed to be a flat surface. FIG. 15*a* is an electric dipole 47 parallel to the surface 46 and FIG. 15*b* is the same dipole perpendicular to the surface. In the first case the dipole 47 induces an "image dipole" 48 counteracting the dipole 47 but in the second case the "image dipole" will help the real dipole. In the first case the presence of the user will decrease performance in terms of radiation resistance and bandwidth while in the second case the performance will be improved as the effective antenna is bigger. Corresponding magnetic antennas are shown in FIGS. 15*c* and 15*d*. The loop antenna 49 induces an image loop 50 which in the case 15*c* radiates in phase with the real loop while the case in FIG. 15*d* is that the two loops counteract each other. The presence of the user will improve performance (radiation resistance and bandwidth) in FIG. 15*c* (where the magnetic dipole is parallel to the skin) while performance will be degraded in case 15*d* where the magnetic dipole is perpendicular to the skin. "performance" may in practical implementation be depending on the matching circuits but with the reflection in the local surface included the radiation will increase which basically simplifies matching and bandwidth in that case. although the invention is described by means of the above examples, naturally, many variations are possible within the scope of the invention.

What is claimed is:

1. A portable radio communication device, comprising:

a housing, antenna means for transmitting and receiving RF signals, transmitting and receiving circuits arranged in the housing, at least a conductive portion, a power source, a user interface, wherein:

said antenna means including a first antenna, being a transmitting antenna, connected to said transmitting circuits, said antenna means including a second antenna, being a receiving antenna, connected to said receiving circuits, said first and second antennas having orthogonal radiating characteristics in relation to each other.

2. The portable radio communication device according to claim 1, wherein at least one of said first and second antennas is of a magnetic dipole type.

3. The portable radio communication device according to claim 1, wherein at least one of said first and second antennas is a magnetic dipole loop antenna.

4. The portable radio communication device according to claim 1, wherein at least one of said first and second antennas is encompassed by the housing of the radio communication device.

5. The portable radio communication device according to claim 1, wherein said first and second antennas are arranged to be encompassed by a housing of the radio communication device, and at least one of said first and second antennas includes at least a portion of said conductive portion of the radio communication device.

6. The portable radio communication device according to claim 1, wherein one of said first and second antennas is of the type electric dipole and the other of said first and second antennas is of the type magnetic dipole.

7. The portable radio communication device according to claim 2, wherein the magnetic dipole essentially is arranged to be directed parallel with a surface of the housing of the radio communication device being in contact with the head of the user, when in use, so that the magnetic dipole essentially is directed parallel with the skin of the user at a region around said surface.

8. The portable radio communication device according to claim 2, wherein the magnetic dipole essentially is directed perpendicular to a surface of the housing of the radio communication device being in contact with the head of the user, when in use, so that the magnetic dipole essentially is directed perpendicular to the skin of the user at a region around said surface.

9. The portable radio communication device according to claim 1, wherein the first and second antennas are of the same electric/magnetic type but directed approximately 90° apart resulting in different polarisation.

10. The portable radio communication device according to claim 1, wherein the first and second antennas physically are included in the same part but giving two antenna functions by different feeding.

11. The portable radio communication device according to claim 1, wherein a third antenna function is included for diversity reception.

12. The portable radio communication device according to claim 1, wherein the first antenna is of a magnetic dipole type, and arranged to be located at an end portion, preferably the top portion, of the radio communication device, the second antenna includes an electric dipole constituted of a portion of the radio communication device, and the second antenna also includes the first antenna acting as a portion of said electric dipole.

13. The portable radio communication device according to claim 1, wherein the first antenna is of a magnetic dipole type, and the second antenna is of a magnetic dipole type.

14. The portable radio communication device according to claim 1, wherein the first antenna is of an electric dipole type, and the second antenna is of the electric dipole type.

15. The portable radio communication device according to claim 1, wherein the antennas of a magnetic dipole type includes a loop formed like an 8 on a substrate, one half of the loop is arranged on one side of the substrate, the other half of the loop is arranged on the other side of the substrate, the two halves of the loop is connected to each other through holes in the substrate, and the loop is arranged to be fed at central feeding portions.

16. The portable radio communication device according to claim 1, wherein the antennas of a magnetic dipole type includes a loop formed on a ferrite core.

17. The portable radio communication device according to claim 1, wherein at least one of the first and second antennas includes a small supporting structure.

18. The portable radio communication device according to claim 1, wherein the housing is a small supporting structure.

19. The portable radio communication device according to claim 1, wherein means are provided for tuning the first and second antennas to multiple frequency bands.

20. The antenna system for transmitting and receiving RF signals from and to a portable radio communication device, comprising:

a first antenna, being a transmitting antenna, and being connectable to transmitting circuits of the radio communication device, a second antenna, being a receiving antenna, and being connectable to receiving circuits of the radio communication device, characterised in that the first and the second antennas have orthogonal radiating characteristics in relation to each other.

21. The antenna system according to claim 20, wherein at least one of said first and second antennas is of a magnetic dipole type.

22. The antenna system according to claim 20, wherein at least one of said first and second antennas is a magnetic dipole loop antenna.

23. The antenna system according to claim 20, wherein at least one of said first and second antennas is arranged to be encompassed by a housing of the radio communication device.

24. The antenna system according to claim 23, wherein said first and second antennas are arranged to be encompassed by a housing of the radio communication device, and at least one of said first and second antennas includes at least a portion of the conductive portion of the radio communication device.

25. The antenna system according to claim 20, wherein one of said first and second antennas is of the type electric dipole and the other of said first and second antennas is of the type magnetic dipole.

26. The antenna system according to claim 22, wherein the magnetic dipole essentially is arranged to be directed parallel with a surface of the housing of the radio communication device being in contact with the head of the user, when in use, so that the magnetic dipole essentially is directed parallel with the skin of the user at a region around said surface.

27. The antenna system according to claim 22, wherein the magnetic dipole essentially is directed perpendicular to a surface of the housing of the radio communication device being in contact with the head of the user, when in use, so that the magnetic dipole essentially is directed perpendicular to the skin of the user at a region around said surface.

28. The antenna system according to claim 20, wherein the first and second antennas are of the same electric/magnetic type but directed approximately 90° apart resulting in different polarisation.

29. The antenna system according to claim 20, wherein the first and second antennas physically are included in the same part but giving two antenna functions by different feeding.

30. The antenna system according to claim 20, wherein a third antenna function is included for diversity reception.

31. The antenna system according to claim 20, wherein the first antenna is of a magnetic dipole type, and arranged to be located at an end portion, preferably the top portion, of the radio communication device, the second antenna includes an electric dipole constituted of a portion of the radio communication device, and the second antenna also includes the first antenna acting as a portion of said electric dipole.

32. The antenna system according to claim 20, wherein the first antenna is of a magnetic dipole type, and the second antenna is of a magnetic dipole type.

33. The antenna system according to claim 20, wherein the first antenna is of an electric dipole type, and the second antenna is of a electric dipole type.

34. The antenna system according to claim 20, wherein the antenna(s) of a magnetic dipole type includes a loop formed like an 8 on the substrate, one half of the loop is arranged on one side of the substrate, the other half of the loop is arranged on the other side of the substrate, the two halves of the loop is connected to each other through holes in the substrate, and the loop is arranged to be fed at central feeding portions.

35. The antenna system according to claim 20, wherein the antennas of a magnetic dipole type includes a loop formed on a ferrite core.

36. The antenna system according to claim 20, wherein at least one of the first and second antennas includes a small supporting structure.

37. The antenna system according to claim 20, wherein the first and second antennas are arranged to be mounted to a small supporting structure.

38. The antenna system according to claim 20, wherein the antenna system is provided means for tuning the first and second antennas to multiple frequency bands.

39. The portable radio communication device, characterized in that it is provided with an antenna system according to claim 20.

* * * * *